United States Patent [19]

Kinsey et al.

[11] 4,303,898

[45] Dec. 1, 1981

[54] LONGITUDINALLY FLANGED WAVEGUIDE

[75] Inventors: Richard R. Kinsey, Dewitt; George W. Halbritter, North Syracuse; David L. Binsley, Liverpool; Allan E. Rasmussen; Howard Q. Totten, both of Fayetteville, all of N.Y.

[73] Assignee: General Electric Company, Syracuse, N.Y.

[21] Appl. No.: 178,441

[22] Filed: Aug. 15, 1980

[51] Int. Cl.[3] ..... H01P 5/18

[52] U.S. Cl. ..... 333/114; 333/239; 333/254

[58] Field of Search ..... 333/113, 114, 254, 248, 333/239

[56] References Cited

U.S. PATENT DOCUMENTS 2,766,431 10/1956 Barker, Jr. .

2,820,201 1/1958 Tomiyasu ..... 333/113 X 2,883,628 4/1959 Heinard .

3,315,187 4/1967 Nakahara et al. ..... 333/239

3,377,571 4/1968 Kinsey .

*Primary Examiner*—Paul L. Gensler

*Attorney, Agent, or Firm*—Carl W. Baker; Richard V. Lang

[57] ABSTRACT

Rectangular waveguides adapted for combination as cross-guide couplers are disclosed. Each waveguide includes opposing sidewalls, a coupling wall and flanges extending from the sidewalls. Each flange has a contact surface in parallel with the coupling wall and is positioned relative to the coupling wall so that the contact surface thereof contacts the coupling wall of the waveguide with which it is combined to form the cross-guide coupler. The coupling wall of one of the waveguides in each coupler includes a coupling aperture. The coupling wall of the other waveguide includes an opening sufficiently larger than the coupling aperture to leave a substantial margin therebetween.

6 Claims, 6 Drawing Figures

LONGITUDINALLY FLANGED WAVEGUIDE

The Government has rights in this invention pursuant to Contract DASG 60-77-C-0098 awarded by the Department of the Army.

BACKGROUND OF THE INVENTION

1. Field of the Invention

This invention relates to RF coupling devices and in particular to rectangular waveguides adapted for combination as cross-guide couplers.

2. Description of the Prior Art

Cross-guide couplers, as commonly constructed, each comprise two rectangular waveguides disposed at right angles with a coupling wall of each mated with that of the other to provide a common wall section through which electromagnetic energy is coupled between the waveguides. Typically, one or more coupling apertures are formed in the common wall section of one waveguide and an opening is formed in the other waveguide by entirely removing the common wall section thereof. The waveguide with the coupling aperture is then inset into the other waveguide such that the coupling walls of the two waveguides are coplanar, resulting in a single wall thickness through which energy is coupled.

The above described arrangement minimizes the effective wall thickness between waveguides thus optimizing coupling. Removal of the wall section causes problems, however, relating to the assembly and sealing of the couplers. For example, during assembly the waveguides must be properly aligned so that the coupling aperture in the one waveguide is properly located with respect to the opening in the other waveguide, and this often requires the construction of a special alignment fixture. After assembly the waveguides must be further processed to electrically and mechanically seal a hairline gap between the periphery of the opening in the one waveguide and the outer surface of the other. Typically, such sealing is accomplished by using a dip brazing or an oven brazing process. These processes are satisfactory for many applications, but have disadvantages. The size of waveguide assemblies that can be so processed is limited by the size of the brazing bath or the oven. Also, the temperature to which the assemblies are heated during the brazing process causes substantial expansion of the waveguides themselves, and waveguide distortion resulting therefrom may be unacceptably large if the waveguides are used in certain applications such as precision phased arrays or frequency scanned arrays.

SUMMARY OF THE INVENTION

It is an object of the invention to provide a rectangular waveguide configured so as to adapt it for formation of crossguide couplers by use of a simple assembly procedure.

It is a further object to provide such a waveguide which enables electrical and mechanical sealing of assembled cross-guide couplers by a simple process that places no limitations on the size thereof.

It is another object to provide a waveguide that enables such sealing without heating the couplers to temperatures causing distortion thereof.

These and other objects of the invention are accomplished by providing appropriately-positioned longitudinal flanges on the waveguide, extending from the sidewalls thereof. The flanges on each waveguide are in parallel relationship with a coupling wall in which the coupling aperture or the opening is to be formed, and are positioned relative to the coupling wall such that they are adapted to contact the coupling wall of a mating waveguide. The flanges provide surfaces in which locating holes may be formed for alignment with similar locating holes in mating waveguides to enable assembly without special alignment fixtures. The flanges also strengthen the waveguide in portions thereof where openings are formed. Additionally, the contact surfaces of the flanges and outer surfaces of the coupling walls with which they come in contact after assembly may be utilized to seal the waveguides by application of an appropriate sealant, thus eliminating the need for brazing assembled waveguides and avoiding the deformation and size limitation problems associated therewith.

In a first embodiment the flanges of the waveguide are positioned such that the contact surfaces thereof are co-planar with the outer surface of the waveguide's coupling wall. Crossguide coupling between first and second waveguides is accomplished by forming one or more coupling apertures in the coupling wall of the first waveguide and by forming a corresponding number of openings having the same shape as the coupling aperture(s) but larger dimensions, in the coupling wall of the second waveguide. The two waveguides are mated, typically at right angles, with the respective coupling aperture(s) and opening(s) aligned and with the flanges and coupling wall of each waveguide in contact with those of the other.

In a second embodiment the flanges of the waveguide are positioned such that the contact surfaces thereof are offset from the outer surface of the waveguide's coupling wall by a dimension equal to the thickness of the coupling wall. Cross-guide coupling between first and second waveguides is accomplished by forming one or more coupling apertures in the coupling wall of the first waveguide and by forming an opening in the second waveguide by removing the portion of the coupling wall that would otherwise contact the coupling wall of the first waveguide. The two waveguides are mated, typically at right angles, with the coupling aperture(s) located within the opening and with the flanges of each waveguide in contact with the coupling wall of the other.

DESCRIPTION OF THE PREFERRED EMBODIMENTS

Embodiment One

Figure 1:
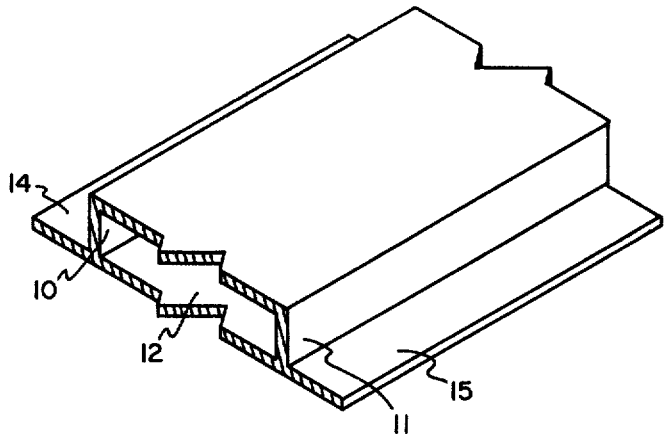
FIG. 1 is a perspective view of a segment of a rectangular waveguide constructed in accordance with the first embodiment of the invention and having a single coupling wall.
Figure 2:
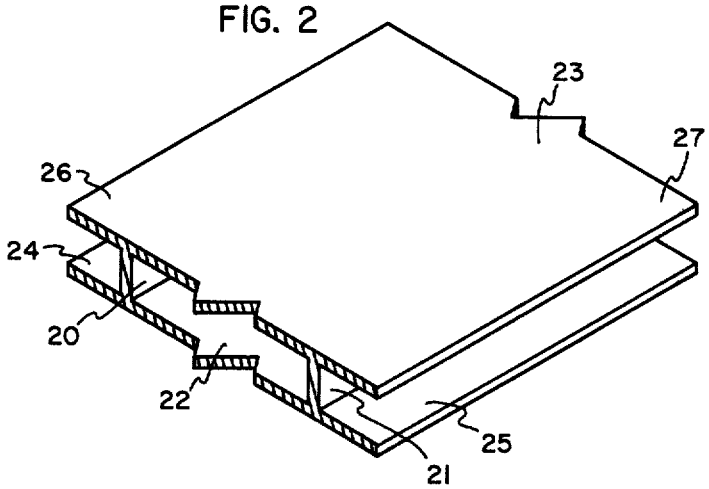
FIG. 2 is a perspective view of a segment of a rectangular waveguide constructed in accordance with the first embodiment of the invention and having two coupling walls.
Figure 3:
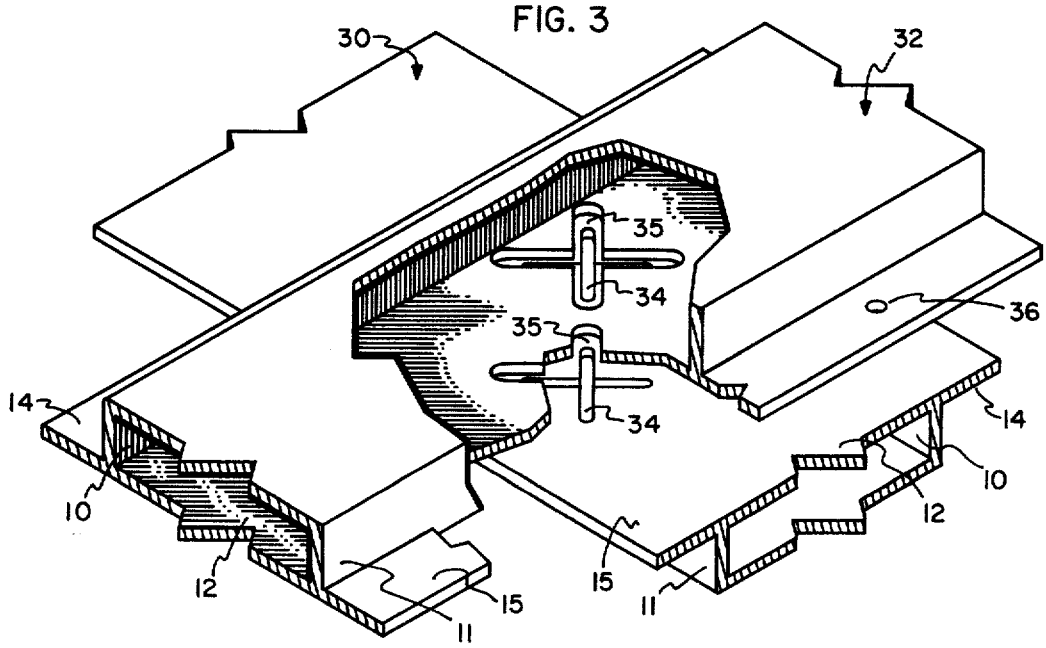
FIG. 3 is a broken perspective view of the crossguide coupling of two of the waveguides shown in FIG. 1.

The first embodiment of the invention is illustrated, in one form thereof, in FIGS. 1, 2 and 3. FIG. 1 illustrates a segment of an extruded rectangular waveguide comprising opposing sidewalls 10, 11, a coupling wall 12 and flanges 14, 15. In the illustrated waveguide the flanges have rectangular cross sections, are of the same thickness as the coupling wall and extend perpendicularly from the sidewalls in alignment with the coupling wall. The thickness and cross-sectional shape of the flanges may be altered from this example as desired, however, as long as the contact surface (the under side of each flange in this figure) lies in the same plane as the outer surface of the coupling wall.

FIG. 2 illustrates a segment of an extruded rectangular waveguide which is very similar to that of FIG. 1, but which includes two coupling walls so that it can be utilized to couple electromagnetic energy from two sides thereof to mated waveguides. This waveguide comprises opposing sidewalls 20, 21, coupling walls 22, 23 and flanges 24, 25, 26, 27. Aside from having the additional coupling wall and two additional flanges aligned therewith, the FIG. 2 waveguide is identical to that of FIG. 1.

FIG. 3 illustrates a pair of the waveguides of the type shown in FIG. 1 mated in cross-guide coupled relationship. (For purposes of comparison with FIG. 1 it should be noted that like numbers identify like parts of specific waveguide configurations in all of the drawing figures.) A first one of the waveguides 30, functioning as a feed guide, carries energy which is to be coupled in part to the second waveguide 32, functioning as a cross-guide. Coupling is effected by means of a pair of coupling apertures 34 formed in the feed guide and a pair of openings 35 formed in the cross-guide and cooperating with the coupling apertures to enable coupling of RF energy between the waveguides.

Although the coupling apertures 34 are shaped as crossed slots, these shapes are examplary only and the actual shapes and dimensions of the coupling apertures utilized will be chosen to effect the desired directivity of energy coupled into the cross-guide. The shapes and dimensions of opening 35 are not arbitrary however. It has been found advantageous to make the openings of the same shape as the respective coupling apertures with which they cooperate and to make the openings sufficiently larger than the coupling apertures to leave a substantial margin therebetween. By making the shape of the openings the same as that of the coupling apertures the areas over which discontinuities in cross-guide impedance, caused by the discontinuity in height of the cross-guide in the area of each opening, can be minimized. The magnitude of energy coupled from the feed guide to the cross-guide is significantly affected by the apparent thickness of the waveguide walls through which the energy is coupled. By making the openings 35 sufficiently larger than the coupling apertures 34, the apparent thickness of these walls effectively becomes equal to that of the coupling wall of waveguide 30.

The above criteria for minimizing impedance discontinuities and maximizing coupling establish upper and lower limits for the size of the openings. For the purpose of minimizing the total area of the waveguide over which impedance discontinuities are experienced it is desirable to make the size of the openings identical to that of the coupling apertures, but for the purpose of optimizing coupling and simplifying aperture/opening registration, it is desirable to make the size of the openings substantially larger than that of the coupling apertures. In practice, the openings are made just large enough to prevent any attenuating influence thereby on coupled energy. For the crossed slot configuration illustrated, lengthening the slots in the opening contributes more toward increasing coupling than does widening the slots. Thus it is generally desirable to form openings having the maximum slot lengths which can be accommodated within the confines of the sidewalls. A cross-guide coupler permitting coupling as great as −6DB before the wall thickness of the opening has any attenuating effect on the coupled energy has been constructed with the following dimensions:

$a=0.617\lambda_o$
$b=0.069\lambda_o$
$t=0.019\lambda_o$
$w_s=0.030\lambda_o$
$l_s=0.394\lambda_o$
$w_w=2w_s=0.060\lambda_o$
$l_w=0.408\lambda_o$ where:

$\lambda_o$ = wavelength of center frequency
a = waveguide inside width
b = waveguide inside height
t = waveguide wall thickness
$w_2$ = width of coupling slots
$l_s$ = length of coupling slots
$w_w$ = width of opening slots
$l_w$ = length of opening slots During formation of the coupling apertures and the openings, locating holes such as that shown at 36 in FIG. 3 are formed in the flanges of both waveguides. These locating holes serve both as means to align the coupling apertures and the openings during assembly of mating waveguides and as means for holding fasteners such as rivets which may be utilized in addition to sealant to hold the waveguides together. The sealant itself, typically a conductive epoxy, is applied to the contact surfaces of the coupling walls and the flanges, effectively sealing the interiors of the waveguides from the outside environment for the purposes of preventing radiation leakage and enabling pressurization, if desired.

Embodiment Two

Figure 4:
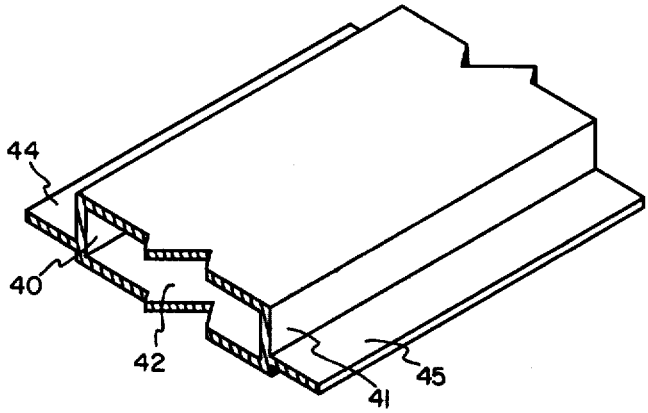
FIG. 4 is a perspective view of a segment of a rectangular waveguide constructed in accordance with the second embodiment of the invention and having a single coupling wall.
Figure 5:
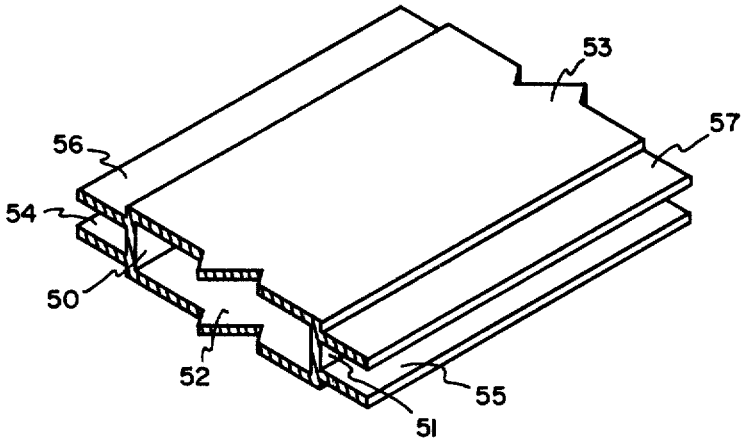
FIG. 5 is a perspective view of a segment of a rectangular waveguide constructed in accordance with the second embodiment of the invention and having two coupling walls.
Figure 6:
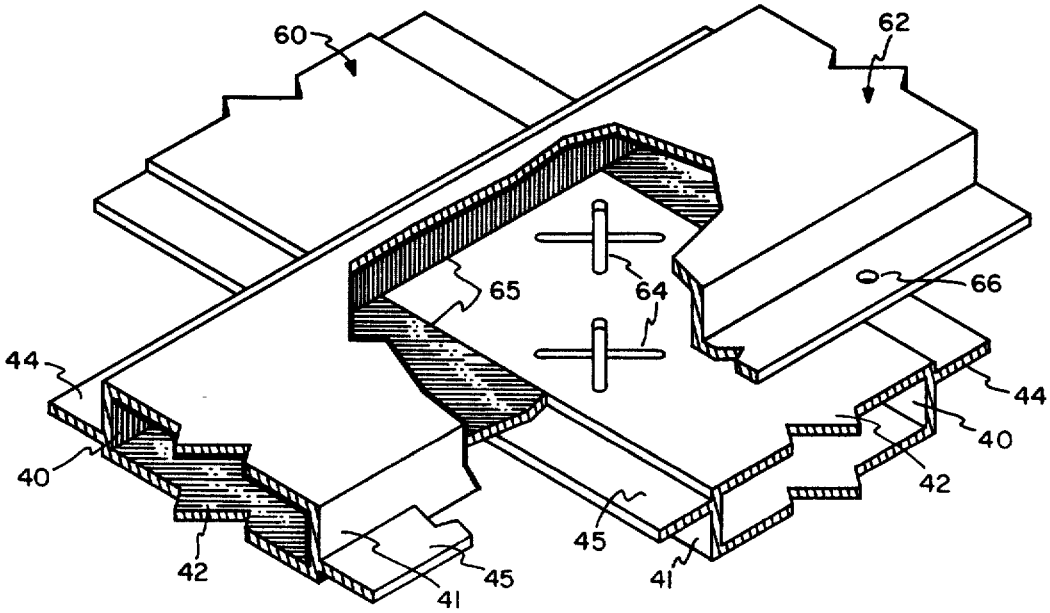
FIG. 6 is a broken perspective view of the cross-guide coupling of two of the waveguides shown in FIG. 4.

The second embodiment of the invention is illustrated, in one form thereof, in FIGS. 4, 5 and 6. FIG. 4 illustrates a segment of an extruded rectangular waveguide comprising opposing sidewalls 40, 41, a coupling wall 42 and flanges 44, 45. In the illustrated waveguide the flanges have rectangular cross sections of the same thickness as the coupling wall and extend perpendicularly from the sidewalls offset from the plane of the coupling wall. The thickness and cross-sectional shape of the flanges may be altered from this example as desired, however, as long as the contact surface (the underside of each flange in this figure) is offset from the outer surface of the coupling wall by a dimension equal to the thickness of the coupling wall.

FIG. 5 illustrates a segment of an extruded rectangular waveguide which is very similar to that of FIG. 4, but which includes two coupling walls so that it can be utilized to couple electromagnetic energy from two sides thereof to mated waveguides. This waveguide comprises opposing side walls 50, 51, coupling walls 52, 53 and flanges 54, 55, 56, 57. Aside from having the additional coupling wall and two additional flanges offset therefrom, the FIG. 5 waveguide is identical to that of FIG. 4.

FIG. 6 illustrates a pair of the waveguides of the type shown in FIG. 4 mated in cross-guide coupled relationship. A first one of the waveguides 60, functioning as a feed guide, carries energy which is to be coupled in part to the second waveguide 62, functioning as a cross guide. Such coupling is effected by means of a pair of coupling apertures 64 formed in the feed guide and an opening 65, formed in the cross-guide and cooperating with the coupling apertures to enable coupling of RF energy between the waveguides. The opening 65 is formed by removing the portion of the coupling wall 42 of the cross guide 62 which would otherwise contact the coupling wall of the feed guide 60 during assembly. Assembly is completed by insetting the coupling wall of the feed guide into the opening 65 such that the coupling walls of the two waveguides lie in the same plane and the coupling apertures 64 are located within the opening 65. Because of the offsetting of the flanges, the contact surface of each flange contacts the coupling wall of the other waveguide.

As in the case of the first embodiment, locating holes, such as that shown at 66, are formed in the flanges of both waveguides during formation of the coupling apertures and the opening. During assembly the sealant is applied to the contact surfaces of the flanges and the portions of the coupling walls with which they come in contact. Note that the flanges enable an effective seal to be formed around the entire periphery of the opening 65 without the need for brazing. It is along this periphery that the aforementioned gap exists in the prior art crossguide couplers. A pinhole does exist at each corner of the opening 65, but this can be blocked by inserting a spacer between the offset flanges at each of the corners.

Although both of the described embodiments have the previously mentioned advantages relating to simplification of the assembly and sealing procedures, they also have advantages relative to each other. For example, the first embodiment is more useful in arrays of waveguides where not all crossing waveguides are coupled, because the positional relationship of each waveguide to all other waveguides crossed thereby is identical whether it is coupled thereto or not. This is not so with respect to the second embodiment, because coupled waveguides are nested within each other while uncoupled waveguides are not, and the array configuration in this case is more complicated. The second embodiment is generally more useful in arrays where all crossing waveguides are coupled. This is so because the nested arrangement of crossing waveguides enables a thinner array feed network to be constructed.

Although specific embodiments have been disclosed it is to be understood that they are only illustrative and the scope of the invention is to be determined from the appended claims. For example, coupled waveguides can be mated at angles other than the orthogonal relationship depicted in the drawing. Also, in some situations it might be advantageous to place the coupling apertures in the cross-guides and the openings in the feed guides.

We claim:

1. A rectangular waveguide including opposing sidewalls and a coupling wall, said waveguide further including a flange extending from each sidewall and having a contact surface in parallel with the coupling wall, and flanges being positioned relative to the coupling wall so as to adapt the waveguide for crossguide coupling with another rectangular waveguide having a similar flange configuration, whereby the contact surface of each flange contacts the coupling wall of the other waveguide.

2. A waveguide as in claim 1 where the flanges are positioned such that the contact surfaces thereof are co-planar with the outer surface of the coupling wall.

3. A waveguide as in claim 1 where the flanges are positioned such that the contact surfaces thereof are offset from the outer surface of the coupling wall by a dimension equal to the thickness of the coupling wall.

4. In combination, first and second crossguide coupled, rectangular waveguides, each including opposing sidewalls and a coupling wall, the coupling wall of the first waveguide including a coupling aperture and the coupling wall of the second waveguide including an opening sufficiently larger than the coupling aperture to leave a substantial margin therebetween, each waveguide further including a flange extending from each sidewall and having a contact surface in parallel with the coupling wall, said flanges being positioned relative to their respective coupling walls so that a contact surface of each flange contacts the coupling wall of the other waveguide.

5. A combination as in claim 4 where the opening has the same shape as the coupling aperture, but larger dimensions, and the flanges of each waveguide are positioned such that the contact surfaces thereof are co-planar with the outer surface of their respective coupling wall.

6. A combination as in claim 4 where the opening is formed by removing the portion of the coupling wall of the second waveguide which would otherwise contact the coupling wall of the first waveguide, and the flanges of each waveguide are positioned such that the contact surfaces thereof are offset from the outer surface of their respective coupling wall by a dimension equal to the thickness of the coupling wall.

* * * * *